US009540740B2

(12) United States Patent
Müller et al.

(10) Patent No.: US 9,540,740 B2
(45) Date of Patent: Jan. 10, 2017

(54) UNDIVIDED ELECTROLYTIC CELL AND USE THEREOF

(71) Applicant: UNITED INITIATORS GMBH & CO. KG, Pullach (DE)

(72) Inventors: Michael Müller, Holzkirchen (DE); Patrick Keller, Tyrlaching (DE); Markus Schiermeier, München (DE)

(73) Assignee: UNITED INITIATORS GMBH & CO. KG, Pullach (DE)

( * ) Notice: Subject to any disclaimer, the term of this patent is extended or adjusted under 35 U.S.C. 154(b) by 0 days.

(21) Appl. No.: 14/407,205

(22) PCT Filed: Jul. 12, 2013

(86) PCT No.: PCT/EP2013/064809
§ 371 (c)(1),
(2) Date: Dec. 11, 2014

(87) PCT Pub. No.: WO2014/009536
PCT Pub. Date: Jan. 16, 2014

(65) Prior Publication Data

US 2015/0167183 A1 Jun. 18, 2015

(30) Foreign Application Priority Data

Jul. 13, 2012 (EP) ..... PCT/EP2012/063783

(51) Int. Cl.
*C25B 1/00* (2006.01)
*C25B 9/06* (2006.01)
(Continued)

(52) U.S. Cl.
CPC . *C25B 9/06* (2013.01); *C25B 1/00* (2013.01); *C25B 1/285* (2013.01); *C25B 1/30* (2013.01)

(58) Field of Classification Search
CPC ..... C25B 9/06; C25B 1/00; C25B 1/30; C25B 1/285
See application file for complete search history.

(56) References Cited

U.S. PATENT DOCUMENTS 3,915,816 A 10/1975 Rossberger
3,964,991 A * 6/1976 Sullins ..... B01D 21/0009 204/272
(Continued)

FOREIGN PATENT DOCUMENTS

CA 1090286 11/1980
CN 1505699 6/2004
(Continued)

OTHER PUBLICATIONS

European Application No. EP11173916 , European Application No. 11173916.5, "Extended European Search Report" dated Sep. 1, 2011.
(Continued)

*Primary Examiner* — Arun S Phasge
(74) *Attorney, Agent, or Firm* — Kilpatrick Townsend & Stockton LLP

(57) ABSTRACT

The present invention relates to a method for producing an ammonium peroxodisulphate or an alkali-metal peroxodisulphate, to an undivided electrolytic cell constructed from individual components and to an electrolytic apparatus constructed from a plurality of electrolytic cells of this type.

17 Claims, 7 Drawing Sheets

(51) Int. Cl.
*C25B 1/28* (2006.01)
*C25B 1/30* (2006.01)

(56) References Cited

U.S. PATENT DOCUMENTS

| | | | | |
|---|---|---|---|---|
| 6,214,197 | B1 | 4/2001 | Kimizuka et al. | |
| 6,533,916 | B1 * | 3/2003 | Puetter | B82Y 30/00 204/290.01 |
| 2002/0014418 | A1 | 2/2002 | Lehmann et al. | |
| 2007/0187254 | A1 * | 8/2007 | Thiele | C25B 1/285 205/344 |
| 2014/0131218 | A1 | 5/2014 | Müller et al. | |

FOREIGN PATENT DOCUMENTS

| | | |
|---|---|---|
| CN | 100591805 | 2/2010 |
| CN | 202144518 | 2/2012 |
| CN | 103827354 | 5/2014 |
| DE | 2757861 | 6/1978 |
| DE | 19913820 | 10/1999 |
| DE | 102009040651 | 4/2011 |
| EP | 428171 | 9/1993 |
| EP | 1148155 | 10/2001 |
| JP | A1977068872 | 6/1977 |
| JP | 2004099914 | 4/2004 |
| JP | 2008501856 | 1/2008 |
| TW | 524893 | 3/2003 |

OTHER PUBLICATIONS

International Application No. PCT/EP2012/063783 , International Patent Application No. PCT/EP2012/063783 , "International Search Report", May 7, 2013.
International Application No. PCT/EP2012/063783 , "International Preliminary Report on Patentability", Jan. 14, 2014.
International Application No. PCT/EP2013/064809 , International Search Report mailed Nov. 27, 2013.
Michaud et al., "Preparation of Peroxodisulfuric Acid Using Boron-Doped Diamond Thin Film Electrodes", Electro Chemical and Solid-State Letters, 3(2) 77-79 (2000).
U.S. Appl. No. 14/232,322 , "Non-Final Office Action", Oct. 13, 2015, 10 pages.
U.S. Appl. No. 14/232,322, "Notice of Allowance", mailed Sep. 22, 2016, 11 pages.
Chinese Patent Application No. CN201380031764.0, "Office Action", mailed May 9, 2016, 8 pages.
U.S. Appl. No. 14/232,322, "Final Office Action", mailed Apr. 19, 2016, 6 pages.
Japanese Patent Application No. JP2014-519570, "Office Action", mailed Feb. 29, 2016, 7 pages. (1 page for translation, 6 pages for Japanese OA).
U.S. Appl. No. 14/232,322 , Corrected Notice of Allowance, Nov. 8, 2016, 7 pages.
U.S. Appl. No. 14/232,322 , Corrected Notice of Allowance, Nov. 28, 2016, 4 pages.
Japanese Patent Application No. 2014519570, 2nd Office Action mailed Oct. 3, 2016 and English translation.

* cited by examiner

*Current densities:*

*The electrolyte has been accordingly concentrated by recirculation*

UNDIVIDED ELECTROLYTIC CELL AND USE THEREOF

PRIOR RELATED APPLICATIONS

This application is a National Phase application of International Application No. PCT/EP2013/064809, filed Jul. 12, 2013, which claims priority to International Application No. PCT/EP2012/063783, filed Jul. 13, 2012, each of which is incorporated herein by reference in its entirety.

One aspect of the present invention relates to a method for producing an ammonium or alkali-metal peroxodisulphate.

It is known from the prior art to produce alkali-metal and ammonium peroxodisulphate by anodic oxidation of an aqueous solution containing the corresponding sulphate or hydrogen sulphate and to extract the resulting salt by crystallisation out of the anolyte. Since in this method the decomposition voltage is above the decomposition voltage of anodic oxygen formation from water, what is known as a promoter, usually thiocyanate in the form of sodium thiocyanate or ammonium thiocyanate, is used to increase the decomposition voltage of the water into oxygen (oxygen overpotential) at a commonly used platinum anode.

Rossberger (U.S. Pat. No. 3,915,816 (A)) describes a method for directly producing sodium persulphate. Undivided cells comprising platinum-coated, titanium-based anodes are described therein as electrolytic cells. The described current efficiencies are based on the addition of a potential-increasing promoter.

According to DE 27 57 861, sodium peroxodisulphate having a current efficiency of 70 to 80% is produced in an electrolytic cell comprising a cathode protected by a diaphragm and a platinum anode, by electrolysing a neutral aqueous anolyte solution having a starting content of from 5 to 9% by weight sodium ions, 12 to 30% by weight sulphate ions, 1 to 4% by weight ammonium ions, 6 to 30% by weight peroxodisulphate ions and a potential-increasing promoter, such as in particular thiocyanate, at a current density of at least 0.5 to 2 $A/cm^2$ using a sulphuric acid solution as a catholyte. After the peroxodisulphate crystallises out of and separates from the anolyte, the mother liquor is mixed with the cathode product, neutralised and supplied to the anode again.

Drawbacks of this method are:

1. The necessity of using a promoter to minimise oxygen development.

2. The necessity for the anode and cathode to be spatially separated by using a suitable membrane in order to achieve the high current efficiencies described. The membranes required therefor are very highly sensitive to abrasion.

3. The requirement of a high current density and thus a high anode potential to obtain an economically acceptable current efficiency.

4. The problems linked to the production of the platinum anode, in particular in respect of obtaining a current efficiency acceptable for technical purposes and a long service life of the anode. Of note here is the continuous platinum erosion, which can be up to 1 g/t of product in the persulphate. This platinum erosion both contaminates the product and also leads to the consumption of a valuable raw material, whereby not least the method costs are increased.

5. The production of persulphates having a low solubility product, i.e. potassium persulphate and sodium persulphate, is thus only possible in an extremely high dilution. This makes a high energy input necessary for crystal formation.

6. When using what is known as the conversion method, produced persulphates have to be recrystallised from the ammonium persulphate solution. Reduced or even entirely lacking purity of the product generally results therefrom.

EP-B 0 428 171 discloses a filter-press-type electrolytic cell for producing peroxo-compounds, including ammonium peroxodisulphate, sodium peroxodisulphate and potassium peroxodisulphate. Platinum foils applied hot-isostatically to a valve metal are used as anodes in this case. A solution of the corresponding sulphate, which solution contains a promoter and sulphuric acid, is used as an anolyte. This method, too, has the above-mentioned problems.

In the method according to DE 199 13 820, peroxodisulphates are produced by anodic oxidation of an aqueous solution containing neutral ammonium sulphate. In order to produce sodium or potassium peroxodisulphate, the solution obtained from the anodic oxidation, which solution contains ammonium peroxodisulphate, is transformed using sodium hydroxide solution or potassium hydroxide solution. After the corresponding alkali-metal peroxodisulphate crystallises and separates off, the mother liquor is recycled in admixture with the catholyte produced during electrolysis. In this method, too, electrolysis takes place in the presence of a promoter on a platinum electrode as an anode.

Although peroxodisulphates have been extracted for decades on a commercial scale by anodic oxidation on a platinum anode, this method furthermore entails severe drawbacks (see also the numbered list above). It is always necessary to add promoters, also referred to as polarisers, to increase the oxygen overpotential and to improve the current efficiency. As oxidation products of these promoters, which necessarily form as by-products during anodic oxidation, toxic substances enter the anode waste gas and have to be removed by gas washing. High current efficiencies further require separation of the anolyte and the catholyte. The anodes, usually entirely covered with platinum, always require a high current density. As a result, current loading of the anolyte volume, the separator and the cathode occurs, whereby additional measures are required for reducing the cathodic current density by three-dimensional structuring of the electrolytic cell and activation. Furthermore, high thermal loading of the unstable peroxodisulphate solution occurs. In order to minimise this loading, structural measures have to be taken, and the cooling requirements also increase. Owing to the limited heat dissipation, the electrode surface has to be delimited, and as a result the installation complexity per cell unit increases. In order to manage the high current loading, electrode support materials having high thermal transfer properties generally also have to be used, which materials are prone to corrosion and are expensive.

P. A. Michaud et al. teach in *Electro Chemical and Solid-State Letters,* 3(2) 77-79 (2000) the production of peroxodisulphuric acid by anodic oxidation of sulphuric acid using a diamond thin-film electrode doped with boron. This document teaches that electrodes of this type have a higher overpotential for oxygen than platinum electrodes. The document does not however give any indication of the technical production of ammonium peroxodisulphates and alkali-metal peroxodisulphates using diamond thin-film electrodes doped with boron. In this case, it is specifically known that sulphuric acid on one hand and hydrogen sulphates, more particularly neutral sulphates, on the other behave very differently during anodic oxidation. Despite the increased overpotential of oxygen at the diamond electrode doped with boron, the main side reaction in addition to the anodic oxidation of sulphuric acid is the development of oxygen and also of ozone.

As part of their invention described in EP 1148155 B1, Stenner and Lehmann already recognised in 2001 that when using a diamond-coated, divided electrolytic cell to produce persulphates, no additional promoter is required to achieve high current efficiencies of this type. A drawback of this method is above all, owing to the sensitive separators as described above, that the production of persulphates having a low solubility product, essentially potassium persulphate and sodium persulphate, is thus only possible in an extremely high dilution, that is to say below the solubility boundary, and this makes a high energy input necessary for crystal formation and salt discharge during evaporation and drying.

It is accordingly an object of the present invention to provide a technical method for producing ammonium peroxodisulphates and alkali-metal peroxodisulphates which overcomes the drawbacks of the known methods or at least only has said drawbacks to a lesser extent and makes it possible to use a diamond-coated, undivided cell for producing persulphates, more particularly those having a low solubility potential in sulphate- and sulphuric-acid-containing electrolytic solutions or electrolytic suspensions, in order in particular to also utilise, in addition to the electrochemical advantages demonstrated as part of this invention, the mechanical and abrasive properties already known from other uses of a diamond-coated support for electrochemical oxidation of sulphates in suspension, as mentioned above.

To achieve this object, the present invention accordingly provides a method for producing an ammonium peroxodisulphate or alkali-metal peroxodisulphate, comprising anodic oxidation of an aqueous electrolyte, containing a salt from among ammonium sulphate, alkali-metal sulphate and/or of the corresponding hydrogen sulphate, in an electrolytic cell, comprising at least one anode and one cathode, a diamond layer doped with a trivalent or pentavalent element and arranged on a conductive support being used as an anode, the electrolytic cell comprising an undivided electrolytic space between the anode and the cathode and the aqueous electrolyte not containing a promoter for increasing the decomposition voltage of water into oxygen.

The salt used for anodic oxidation from among ammonium sulphate, alkali-metal sulphate and/or the corresponding hydrogen sulphates can be any alkali-metal sulphate or corresponding hydrogen sulphate. Within the context of the present application, the use of sodium sulphate and/or potassium sulphate and/or the corresponding hydrogen sulphate is, however, particularly preferred.

Within the meaning of the present invention, a "promoter" or "polariser" is any means which is known to a person skilled in the art as an additive during electrolysis for increasing the decomposition voltage of water into oxygen or for improving the current efficiency. An example of a promoter of this type which is used in the prior art is thiocyanate, such as sodium thiocyanate or ammonium thiocyanate. According to the invention, a promoter of this type is not used. In other words, in the method according to the invention, the electrolyte has a promoter concentration of 0 g/l. By not using a promoter in the method, for example purification requirements relating to resulting typical electrolysis gases are not necessary.

In the method according to the invention, an anode is used which comprises a diamond layer which is doped with a trivalent or pentavalent element and arranged on a conductive support. An advantage of this feature is the very high wear resistance of the diamond coating. Long-term tests have shown that electrodes of this type have a minimum service life of more than 12 years.

The anode used can be of any shape.

Any anode support material known to a person skilled in the art can be used in this case. In a preferred embodiment, in the present invention the support material is selected from the group consisting of silicon, germanium, titanium, zirconium, niobium, tantalum, molybdenum, tungsten, carbides of these elements, and/or aluminium or combinations of these elements.

The diamond layer doped with a trivalent or pentavalent element is applied to this support material. The doped diamond layer is thus an n-type conductor or a p-type conductor. In this case, it is preferred that a boron-doped and/or phosphorus-doped diamond layer is used. The amount of doping is set such that the desired, generally just the sufficient, conductivity is achieved. For example, when doping with boron, the crystalline structure contains up to 10,000 ppm boron.

The diamond layer can be applied over the entire surface or in portions, such as only on the front or only on the back of the support material.

Methods for applying the diamond layer are known to a person skilled in the art. The diamond electrodes can more particularly be produced in two specific chemical vapour deposition (CVD) methods. These are the microwave plasma CVD method and the hot filament CVD method. In both cases, the gas phase, which is activated to form plasma by microwave radiation or thermally by hot filaments, is formed from methane, hydrogen and optionally further additives, more particularly a gaseous compound of the doping agent.

A p-type semi-conductor can be provided by using a boron compound, such as trimethylboron. An n-type semiconductor is obtained by using a gaseous phosphorus compound as a doping agent. By depositing the doped diamond layer on crystalline silicon, a particularly dense and non-porous layer is obtained—a film thickness of around 1 μm is normally sufficient. In this case, the diamond layer is preferably applied in a film thickness of approximately 0.5 μm to 5 μm, preferably approximately 0.8 μm to 2.0 μm, and particularly preferably approximately 1.0 μm, to the anode support material used according to the invention.

As an alternative to depositing the diamond layer on a crystalline material, the deposition can also take place on a self-passivating metal, such as titanium, tantalum, tungsten or niobium. For producing a particularly suitable boron-doped diamond layer on a silicon single crystal, reference is made to the above-mentioned article by P. A. Michaud.

Within the context of the present invention, the use of an anode comprising a niobium- or titanium support having a boron-doped diamond layer, more particularly of a boron-doped diamond layer with up to 10,000 ppm boron in the crystalline structure, is particularly preferred.

The cathode used in the method according to the invention is preferably made from lead, carbon, tin, platinum, nickel, alloys of these elements, zirconium and/or acid-resistant high-grade steels, as are known to a person skilled in the art. The cathode can be of any shape.

In the electrolytic cell used according to the invention, the electrolytic space between the anode and the cathode is undivided, that is to say there is not a separator between the anode and the cathode. The use of an undivided cell makes possible electrolytic solutions having very high solids concentrations, whereby in turn the energy expenditure for salt extraction, essentially crystallisation and water evaporation, is significantly reduced directly proportionally to the increase in the proportion of solids, but is reduced at least to 25% of that of a divided cell.

In preferred embodiments, the method according to the invention is performed in a two-dimensional or three-dimensional cell. In this case, the cell is preferably formed as a flat cell or a tubular cell.

In particular, the use of a tubular geometry, that is to say a tubular cell consisting of an inner tube as an anode, preferably made from diamond-coated niobium, and an outer tube as a cathode, preferably made of acid-resistant high-grade steel is, combined with low material costs, an advantageous construction. The use of an annular gap as a common electrolytic space is preferred, and leads to uniform flow conditions which thus have low flow loss, and thus to a high level of utilisation of the available electrolytic surfaces, and this in turn means a high current efficiency. The manufacturing costs of a cell of this type are low in comparison with what is known as a flat cell.

In a preferred embodiment of the method according to the invention, a plurality of electrolytic cells are combined, preferably in the form of a double-tube bundle or two-dimensionally.

The electrolyte used in the method according to the invention preferably has an acidic, preferably sulphuric, or neutral pH.

In a further preferred embodiment of the invention, the electrolyte is moved in a circuit through the electrolytic cell during the method. As a result, an electrolytic temperature in the cell, which temperature accelerates the decomposition of the persulphates and is thus undesirably high, is prevented.

In a further preferred embodiment, the method comprises removing electrolytic solution from the electrolytic circuit. This can take place more particularly for extracting produced peroxodisulphate. A further preferred embodiment therefore relates to the extraction of produced peroxodisulphates by crystallisation and separation of the crystals from the electrolytic solution by forming an electrolytic liquor, the electrolyte solution already preferably having been removed from the electrolytic circuit. A further preferred embodiment comprises recirculating the electrolytic mother liquor, more particularly if previously produced peroxodisulphates have been separated off, by increasing the content of acid, sulphate and/or hydrogen sulphate in the electrolytic cell.

According to the invention, the anodic oxidation is preferably performed at an anodic current density of from 50 to 1500 mA/cm$^2$ and more preferably of approximately 50 to 1200 mA/cm$^2$. A particularly preferred current density used is in the range of from 60 to 975 mA/cm$^2$.

The electrolyte used in the method according to the invention preferably has a total solids content of approximately 0.5 to 650 g/l. The (working) electrolyte preferably contains approximately 100 to approximately 500 g/l persulphate, more preferably approximately 150 to approximately 450 g/l persulphate and most preferably 250 to 400 g/l persulphate. The method according to the invention thus makes possible high solids concentrations in the electrolytic solution, without the addition of a potential-increasing agent or promoter and the requirements resulting therefrom on waste gas and waste water treatment, combined with high current efficiencies in peroxodisulphate production.

Furthermore, the electrolytic solution preferably contains approximately 0.1 to approximately 3.5 mol sulphuric acid per liter (l) electrolytic solution, more preferably 1 to 3 mol sulphuric acid per l electrolytic solution and most preferably 2.2 to 2.8 mol sulphuric acid per l electrolytic solution.

In summary, an electrolyte having the following composition is particularly preferably used in the method according to the invention: per liter electrolyte 150 to 500 g persulphate and 0.1 to 3.5 mol sulphuric acid per mole electrolytic solution. The total solids content is preferably 0.5 g/l to 650 g/l, more preferably 100 to 500 g/l and most preferably 250 to 400 g/l, the proportion of sulphate being variable here. The proportion of promoter is 0 g/l.

The invention further relates to an undivided electrolytic cell constructed from individual components, to an electrolytic apparatus constructed from a plurality of electrolytic cells of this type and to the use thereof for oxidation of an electrolyte.

"Electrolysis" is understood to mean a chemical change brought about when passing current through an electrolyte, which change is expressed in a direct transformation of electrical energy into chemical energy by the mechanism of electrode reactions and ionic migration. The most technically significant electrochemical transformation is the electrolysis of saline solution, in which sodium hydroxide solution and chlorine gas form. Nowadays, inorganic peroxides are also commercially produced in electrolytic cells.

In commercial processes, it is particularly desirable to be able to operate reactions at high concentrations of reagents and corresponding products. High product concentrations ensure simple preparation of the end product, since in the case of reaction products in solution, the solvent has to be removed. During electrolysis of highly concentrated electrolytes, the energy expenditure of the downstream preparation of the electrolysis products can thus be reduced.

However, applications having very high proportions of solids place high requirements on the components of the electrolytic cell owing to the abrasive effect of the electrolyte. In particular, the diaphragm, which prevents the reaction products of the anode and cathode spaces from mixing in divided electrolytic cells, does not permanently withstand electrolytic processes at high concentrations. In the case of high proportions of solids, electrolysis can only be performed in undivided cells, in which the anode space and the cathode space do not have to be spatially separated by inserting a suitable membrane. Undivided cells of this type are used in particular when neither reagents nor products which are produced at the anode or the cathode are changed by the other electrode process in a disruptive manner or react with one another.

Furthermore, the anode and cathode materials also have to meet the mechanical requirements at high solids concentrations and therefore have to be extremely wear-resistant.

In order to design the electrolysis to be as economical as possible, the electrolytic cells have to be constructed such that electrolysis can be performed at the highest possible current densities. This is only possible if the anode and the cathode have good electrical conductivity and are chemically inert relative to the electrolyte. Normally, graphite or platinum is used as the anode material. However, these materials have the drawback that they do not have sufficiently high abrasion resistance at high solids concentrations.

The production of mechanically extremely stable and inert electrodes is disclosed in DE 199 11 746. In this case, electrodes are coated with an electrically conductive diamond layer, the diamond layer being applied using a chemical vapour deposition method (CVD).

It is an object of the present invention to provide an electrolytic cell which makes possible a continuous and optimised electrolytic process at high solids concentrations (of up to approximately 650 g/l) and in high current density ranges (of up to approximately 1500 mA/cm$^2$). The electrolytic cell is to be adapted to the electrochemical reactions to be performed, and individual components can be easily replaced without the cell body itself being destroyed.

Surprisingly, the object could be achieved by an electrolytic cell comprising the components:

(a) at least one tubular cathode, (b) at least one rod-shaped or tubular anode, which comprises a conductive support coated with a conductive diamond layer, (c) at least one inlet tube, (d) at least one outlet tube, and (e) at least one distributing device.

In the electrolytic cell, the anode and the cathode are preferably arranged mutually concentrically, such that the electrolytic space is formed as an annular gap between the inner anode and the outer cathode. In this embodiment, the diameter of the cathode is thus greater than that of the anode.

In a preferred embodiment, the electrolytic space does not contain a membrane or a diaphragm. In this case, it is an electrolytic cell comprising a common electrolytic space, that is to say the electrolytic cell is undivided.

The spacing between the anode outer surface and the cathode inner surface is preferably between 1 and 20 mm, more preferably between 1 and 15 mm, still more preferably between 2 and 10 mm and most preferably between 2 and 6 mm.

The internal diameter of the cathode is preferably between 10 and 400 mm, more preferably between 20 and 300 mm, and still more preferably between 25 and 250 mm.

In a preferred embodiment, the anode and the cathode are, mutually independently, between 20 and 120 cm long, more preferably between 25 and 75 cm long.

The length of the electrolytic space is preferably at least 20 cm, more preferably at least 25 cm, and is at most, preferably 120 cm, more preferably 75 cm.

The cathode used according to the invention is preferably made from lead, carbon, tin, platinum, nickel, alloys of these elements, zirconium and/or iron alloys, in particular from high-grade steel, more particularly from acid-resistant high-grade steel. In a preferred embodiment, the cathode is made from acid-resistant high-grade steel.

The base material of the rod-shaped or tubular, preferably tubular, anode is preferably silicon, germanium, titanium, zirconium, niobium, tantalum, molybdenum, tungsten, carbides of these elements, and/or aluminium or combinations of these elements.

The anode support material can be identical to the anode base material or can be different therefrom. In a preferred embodiment, the anode base material functions as a conductive support. Any conductive material known to a person skilled in the art can be used as a conductive support. Particularly preferred support materials are silicon, germanium, titanium, zirconium, niobium, tantalum, molybdenum, tungsten, carbides of these elements, and/or aluminium or combinations of these elements. Particularly preferably, silicon, titanium, niobium, tantalum, tungsten or carbides of these elements, more preferably niobium or titanium, still more preferably niobium, is used as a conductive support.

A conductive diamond layer is applied to this support material. The diamond layer can be doped with at least one trivalent or at least one pentavalent main group or B-group element. The doped diamond layer is thus an n-type conductor or a p-type conductor. In this case, it is preferred that a boron-doped and/or phosphorus-doped diamond layer is used. The amount of doping is set such that the desired, generally just the sufficient, conductivity is achieved. For example, when doping with boron, the crystalline structure can contain up to 10,000 ppm, preferably from 10 ppm to 2000 ppm, boron and/or phosphorus.

The diamond layer can be applied over the entire surface or in portions, preferably over the entire outer surface of the rod-shaped or tubular anode. The conductive diamond layer is preferably non-porous.

Methods for applying the diamond layer are known to a person skilled in the art. The diamond electrodes can more particularly be produced in two specific chemical vapour deposition (CVD) methods. These are the microwave plasma CVD method and the hot filament CVD method. In both cases, the gas phase, which is activated to form plasma by microwave radiation or thermally by hot filaments, is formed from methane, hydrogen and optionally further additives, more particularly a gaseous compound of the doping agent.

A p-type semi-conductor can be provided by using a boron compound, such as trimethylboron. An n-type semiconductor is obtained by using a gaseous phosphorus compound as a doping agent. By depositing the doped diamond layer on crystalline silicon, a particularly dense and non-porous layer is obtained. In this case, the diamond layer is preferably applied in a film thickness of approximately 0.5 μm to 5 μm, preferably approximately 0.8 μm to 2.0 μm, and particularly preferably approximately 1.0 μm, to the conductive support used according to the invention. In another embodiment, the diamond layer is preferably applied in a film thickness of 0.5 μm to 35 μm, preferably 5 μm to 25 μm, and most preferably 10 to 20 μm, to the conductive support used according to the invention.

As an alternative to depositing the diamond layer on a crystalline material, the deposition can also take place on a self-passivating metal, such as titanium, tantalum, tungsten or niobium. For producing a particularly suitable boron-doped diamond layer on a silicon single crystal, reference is made to P. A. Michaud (Electrochemical and Solid State Letters, 3(2) 77-79 (2000)).

Within the context of the present invention, the use of an anode comprising a niobium- or titanium support having a boron-doped diamond layer, more particularly having a diamond layer doped with up to 10,000 ppm boron, is particularly preferred.

The diamond-coated electrodes are distinguished by very high mechanical strength and abrasion resistance.

Preferably the anode and/or the cathode, more preferably the anode and the cathode, still more preferably the anode, are connected to the current source via the distributing device. If the anode and the cathode are connected to the current source via the distributing device, it has to be ensured that the distributing device is accordingly electrically insulated. In any case, attention should be paid to good electrical contact between the anode and/or cathode and the distributing device.

The distributing device further ensures that the electrolyte is uniformly fed from the inlet tube into the electrolytic space. Once the electrolyte has passed through the electrolytic space, the transformed electrolyte (electrolysis product) is effectively collected by means of at least one upstream distributing device and is conducted away via an outlet tube.

The distributing devices according to the invention, mutually independently, preferably consist of silicon, germanium, titanium, zirconium, niobium, tantalum, molybdenum, tungsten, carbides of these elements, and/or aluminium or combinations of these elements, particularly preferably of titanium.

The distributing devices preferably comprise at least one connector for at least one outlet or inlet tube, and one connector for the anode. The connector for the anode forms on optionally closed hollow cylinder, which is flush with the anode tube or rod. In the case of tubular anodes, the hollow cylinder can seal the anode tube in the distributing devices, such that no electrolyte can enter the interior of the anode. Alternatively, the connector of the distributing device at the anode can comprise a relief hole in the anode tube. As a result, electrolyte is prevented from being able to flow into the anode tube in the event of excessive pressures at the distributing element.

The optionally closed hollow cylinder of the distributing device can be applied to the support material of the anode or even directly to the diamond-coated support. In the latter case, the support and the distributing device are thus mutually separated by the conductive diamond layer. In a particularly preferred embodiment, the distributing device is permanently connected, particularly preferably welded, to the anode. This is particularly advantageous if operations are being performed at high currents. For example, the anode and the distributing device can be welded by diffusion welding, electron beam welding or laser welding.

Radial holes are distributed over the periphery of the hollow cylinder of the distributing device. The distributing device preferably comprises three, more preferably four, and still more preferably five, radial holes. Through the radial holes in the distributing device, the electrolyte can be distributed into the electrolytic space uniformly and in a flow-optimised manner and, after passing through the electrolytic space, the electrolysis product can be effectively conducted away.

The electrolyte is preferably supplied to the electrolytic cell and more particularly the distributing device via the inlet tube. The electrolysis product is preferably conducted out of the electrolytic cell via the outlet tube, more particularly after the electrolysis product has been collected in the distributing device.

In a preferred embodiment, the distributing device is formed such that it also seals the tubular cathode, such that no electrolyte or electrolysis product can escape from the cathode.

The distributing device achieves a plurality of objects, mutually independently:

- sealing the tubular anode, such that no electrolyte can enter the anode interior or pressure regulation by a relief hole in the anode space or/and
- electrically contacting the anode or/and cathode with the current source or/and
- distributing the electrolyte in the electrolytic space (optimal hydraulic distribution over the entire exchange surface) uniformly and in a flow-optimised manner or/and
- effectively conducting the electrolysis product out of the electrolytic space or/and
- sealing the tubular cathode or/and
- reducing flow losses.

The components anode, cathode, distributing device and inlet and outlet tubes can be assembled to form an electrolytic cell by means of corresponding assembly apparatuses known to a person skilled in the art.

Owing to the modular construction of the anode, cathode, distributing device, inlet and outlet tubes, the individual components can be formed from different materials and can be individually exchanged or replaced if damaged. It was thus possible to interconnect the diamond anode according to the invention and the other components, which are produced from inexpensive materials, in a simple manner to form an electrolytic cell that is compact in its construction.

The tubular electrolytic cell is further distinguished by high strength combined with low material usage. Parts which wear over time for example owing to the abrasive action of the electrolyte can be individually replaced, such that economical material usage is also ensured in this regard. In the tubular electrolytic cell, flow passes through the electrolytic space in an optimised manner, whereby flow losses are prevented and the surface is optimally utilised for the electrochemical substance exchange. A continuous and uniform electrolytic process at high solids concentrations and in high current density ranges is possible owing to the electrode materials and electrode assembly.

A further aspect of the present invention is an electrolytic apparatus which comprises at least two electrolytic cells according to the invention, the electrolyte flowing through the electrolytic cells one after the other and the electrolytic cells being operated so as to be electrochemically connected in parallel. The system capacities can thus be configured flexibly and without limits.

The electrolytic cell according to the invention or the electrolytic apparatus according to the invention is suitable in particular for oxidation of an electrolyte. As mentioned above, the undivided electrolytic cells are suitable for oxidation of an electrolyte particularly if neither the electrolyte product nor the electrolysis product which are produced or transformed at the anode or the cathode are changed by the other electrode process in a disruptive manner or react with one another.

The electrolytic cells according to the invention can be operated with a current density of between 50 and 1500 $mA/cm^2$, preferably of between 50 and 1200 $mA/cm^2$, and more preferably of 60 to 975 $mA/cm^2$, and thus make possible commercial and economic processes.

The electrolytic cells/electrolytic apparatuses according to the invention can further be used at very high solids concentrations of between 0.5 to 650 g/l, preferably 100 to 500 g/l, more preferably 150 to 450 g/l and still more preferably 250 to 400 g/l.

The electrolytic cells/electrolytic apparatuses according to the invention are suitable in particular for the anodic oxidation of sulphate to peroxodisulphate.

The electrolytic cells/electrolytic apparatuses according to the invention have proved successful in particular for producing peroxodisulphates.

It is known from the prior art to produce alkali-metal and ammonium peroxodisulphate by anodic oxidation of an aqueous solution containing the corresponding sulphate or hydrogen sulphate and to extract the resulting salt by crystallisation out of the anolyte. Since in this method the decomposition voltage is above the decomposition voltage of anodic oxygen formation from water, what is known as a promoter or polariser, usually thiocyanate in the form of sodium thiocyanate or ammonium thiocyanate, is used to increase the decomposition voltage of the water into oxygen (oxygen overpotential) at a commonly used platinum anode.

Rossberger (U.S. Pat. No. 3,915,816 (A)) describes a method for directly producing sodium persulphate. Undivided cells comprising platinum-coated, titanium-based anodes are described therein as electrolytic cells. The described current efficiencies are based on the addition of a potential-increasing promoter.

According to DE 27 57 861, sodium peroxodisulphate having a current efficiency of 70 to 80% is produced in an electrolytic cell comprising a cathode protected by a diaphragm and a platinum anode, by electrolysing a neutral aqueous anolyte solution having a starting content of from 5 to 9% by weight sodium ions, 12 to 30% by weight sulphate ions, 1 to 4% by weight ammonium ions, 6 to 30% by weight peroxodisulphate ions and a potential-increasing promoter, such as in particular thiocyanate, at a current density of at least 0.5 to 2 A/cm$^2$ using a sulphuric acid solution as a catholyte. After the peroxodisulphate crystallises out of and separates from the anolyte, the mother liquor is mixed with the cathode product, neutralised and supplied to the anode again.

Drawbacks of this method are:

1. The necessity of using a promoter to minimise oxygen development.

2. The necessity for the anode and cathode to be spatially separated by using a suitable membrane in order to achieve the high current efficiencies described. The membranes required therefor are very highly sensitive to abrasion.

3. The requirement of a high current density and thus a high anode potential to obtain an economically acceptable current efficiency.

4. The problems linked to the production of the platinum anode, in particular in respect of obtaining a current efficiency acceptable for technical purposes and a long service life of the anode. Of note here is the continuous platinum erosion, which can be up to 1 g/t of product in the persulphate. This platinum erosion both contaminates the product and also leads to the consumption of a valuable raw material, whereby not least the method costs are increased.

5. The production of persulphates having a low solubility product, essentially potassium persulphate and sodium persulphate, is thus only possible in an extremely high dilution. This makes a high energy input necessary for crystal formation.

6. When using what is known as the conversion method, produced persulphates have to be recrystallised from the ammonium persulphate solution. Reduced or even entirely lacking purity of the product generally results therefrom.

EP-B 0 428 171 discloses a filter-press-type electrolytic cell for producing peroxo-compounds, including ammonium peroxodisulphate, sodium peroxodisulphate and potassium peroxodisulphate. Platinum foils applied hot-isostatically to a valve metal are used as anodes in this case. A solution of the corresponding sulphate, which solution contains a promoter and sulphuric acid, is used as an anolyte. This method, too, has the above-mentioned problems.

In the method according to DE 199 13 820, peroxodisulphates are produced by anodic oxidation of an aqueous solution containing neutral ammonium sulphate. In order to produce sodium or potassium peroxodisulphate, the solution obtained from the anodic oxidation, which solution contains ammonium peroxodisulphate, is transformed using sodium hydroxide solution or potassium hydroxide solution. After the corresponding alkali-metal peroxodisulphate crystallises and separates off, the mother liquor is recycled in admixture with the catholyte produced during electrolysis. In this method, too, electrolysis takes place in the presence of a promoter on a platinum electrode as an anode.

Although peroxodisulphates have been extracted for decades on a commercial scale by anodic oxidation on a platinum anode, this method still entails severe drawbacks (see also the numbered list above). It is always necessary to add promoters, also referred to as polarisers, to increase the oxygen overpotential and to improve the current efficiency. As oxidation products of these promoters, which necessarily form as by-products during anodic oxidation, toxic substances enter the anode waste gas and have to be removed by gas washing. High current efficiencies further require separation of the anolyte and the catholyte. The anodes, usually entirely covered with platinum, always require a high current density. As a result, current loading of the anolyte volume, the separator and the cathode occurs, whereby additional measures are required for reducing the cathodic current density by three-dimensional structuring of the electrolytic cell and activation. Furthermore, high thermal loading of the unstable peroxodisulphate solution occurs. In order to minimise this loading, structural measures have to be taken, and the cooling requirements also increase. Owing to the limited heat dissipation, the electrode surface has to be delimited, and as a result the installation complexity per cell unit increases. In order to manage the high current loading, electrode support materials having high thermal transfer properties generally also have to be used, which materials are prone to corrosion and are expensive.

P. A. Michaud et al. teach in *Electro Chemical and Solid-State Letters,* 3(2) 77-79 (2000) the production of peroxodisulphuric acid by anodic oxidation of sulphuric acid using a diamond thin-film electrode doped with boron. This document teaches that electrodes of this type have a higher overpotential for oxygen than platinum electrodes. The document does not however give any indication of the technical production of ammonium peroxodisulphates and alkali-metal peroxodisulphates using diamond thin-film electrodes doped with boron. In this case, it is specifically known that sulphuric acid on one hand and hydrogen sulphates, more particularly neutral sulphates, on the other, behave very differently during anodic oxidation. Despite the increased overpotential of oxygen at the diamond electrode doped with boron, the main side reaction in addition to the anodic oxidation of sulphuric acid is the development of oxygen and also of ozone.

As part of their invention described in EP 1148155 B1, Stenner and Lehmann already recognised in 2001 that when using a diamond-coated, divided electrolytic cell to produce persulphates, no additional promoter is required to achieve high current efficiencies of this type. A drawback of this invention is above all, owing to the sensitive separators as described above, that the production of persulphates having a low solubility product, essentially potassium persulphate and sodium persulphate, is thus only possible in an extremely high dilution, that is to say below the solubility boundary, and this makes a high energy input necessary for crystal formation and salt discharge during evaporation and drying.

The salt used for anodic oxidation from among ammonium sulphate, alkali-metal sulphate and/or the corresponding hydrogen sulphates can be any alkali-metal sulphate or corresponding hydrogen sulphate. Within the context of the present application, the use of sodium sulphate and/or potassium sulphate and/or the corresponding hydrogen sulphate is, however, particularly preferred.

In the electrolytic cell used according to the invention, the electrolytic space between the anode and the cathode is undivided, that is to say there is not a separator between the anode and the cathode. The use of an undivided cell makes possible electrolytic solutions having very high solids concentrations, whereby in turn the energy expenditure for salt extraction, essentially crystallisation and water evaporation, is significantly reduced directly proportionally to the increase in the proportion of solids, but is reduced at least to 25% of that of a divided cell. According to the invention, it is also not necessary to use a promoter.

Within the meaning of the present invention, a "promoter" is any means which is known to a person skilled in the art as an additive during electrolysis for increasing the decomposition voltage of water into oxygen or for improving the current efficiency. An example of a promoter of this type which is used in the prior art is thiocyanate, such as sodium thiocyanate or ammonium thiocyanate.

The electrolyte used in the method according to the invention preferably has an acidic, preferably sulphuric, or neutral pH.

The electrolyte can be moved in a circuit through the electrolysis cell during the method. As a result, an electrolytic temperature in the cell, which temperature accelerates the decomposition of the persulphates and is thus undesirably high, is prevented.

Electrolytic solution is removed from the electrolytic circuit for extracting produced peroxodisulphate. The produced peroxodisulphates can be extracted from the electrolytic solution by crystallisation and separation of the crystals by forming an electrolytic liquor.

At the start of electrolysis, the electrolyte used preferably has a total solids content of approximately 0.5 to 650 g/l. At the start of transformation, the electrolyte preferably contains approximately 100 to approximately 500 g/l sulphate, more preferably approximately 150 to approximately 450 g/l sulphate and most preferably 250 to 400 g/l sulphate. The use of the electrolytic cell/electrolytic apparatus according to the invention thus makes possible high solids concentrations in the electrolytic solution, without the addition of a potential-increasing agent or promoter and the requirements resulting therefrom on waste gas and waste water treatment, combined with high current efficiencies in peroxodisulphate production.

Furthermore, the electrolytic solution preferably contains approximately 0.1 to approximately 3.5 mol sulphuric acid per liter (l) electrolytic solution, more preferably 1 to 3 mol sulphuric acid per l electrolytic solution and most preferably 2.2 to 2.8 mol sulphuric acid per l electrolytic solution.

In summary, an electrolyte having the following composition is particularly preferably used in the method according to the invention: per liter starting electrolyte 150 to 500 g persulphate and 0.1 to 3.5 mol sulphuric acid per 1 electrolytic solution. The total solids content is preferably 0.5 g/l to 650 g/l, more preferably 100 to 500 g/l and most preferably 250 to 400 g/l. The proportion of promoter is 0 g/l.

FIGURES

FIG. 1 shows current efficiencies in comparison with different cell types with and without rhodanide (promoter).

FIG. 2*a* shows current/voltage in Pt/HIP and diamond electrodes.

FIG. 2*b* shows current/efficiency in Pt/HIP and diamond electrodes.

FIG. 3 shows a possible embodiment of an electrolytic cell according to the present invention.

Figure 4:
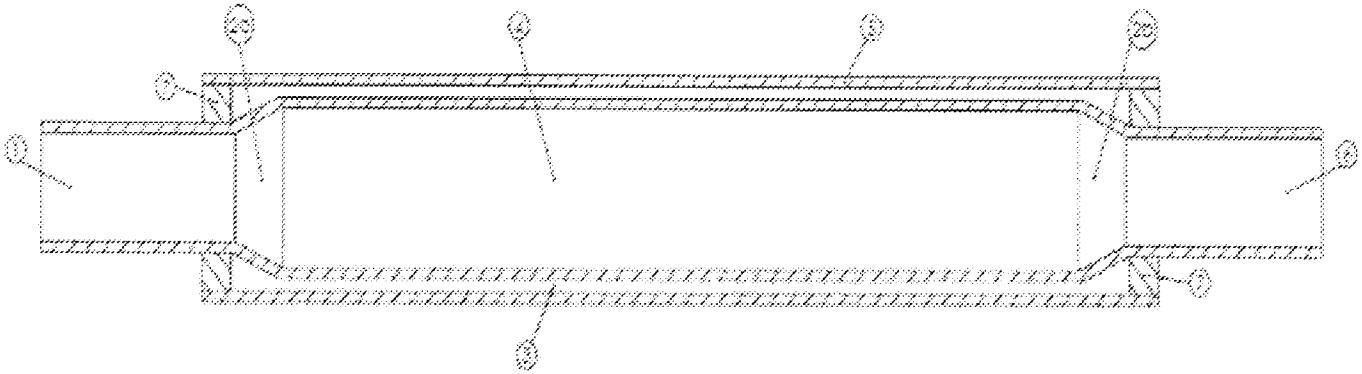
FIG. 4 is a cross-section of an electrolytic cell according to the invention.

A cross-section of this model is shown schematically in FIG. 4. The electrolyte enters the distributing device (2*a*) through the inlet tube (1) and is fed from there to the electrolyte space (3) in a flow-optimised manner. The electrolyte space (3) is formed by the annular gap between the outer surface of the anode (4) and the inner surface of the cathode (5). The electrolysis product is collected by the distributing device (2*b*) and is transferred into the outlet tube (6). Seals (7) close the electrolyte space between the inlet tube and outlet tube and the inner surface of the cathode.

In a preferred embodiment, the distributing device (2) can be constructed such that the distributing device takes on the function of sealing the electrolyte space at the same time.

Figure 5:
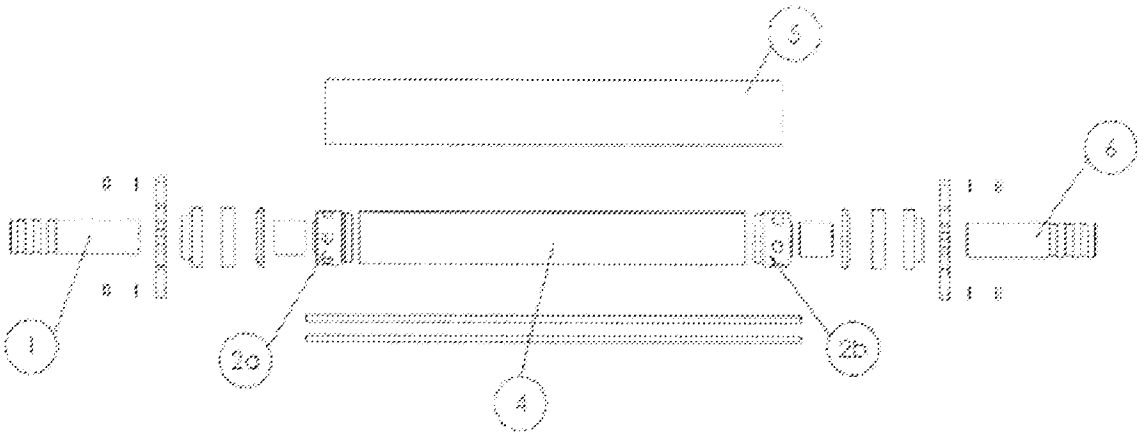
FIG. 5 shows the individual components of the electrolytic cell according to the invention.

FIG. 5 shows the individual components of the electrolytic cell according to the invention. The numbering is identical to FIG. 4. Further components for sealing the electrolytic cell and for assembly are shown in FIG. 5, but are not numbered. These components are known to a person skilled in the art and can be replaced as desired.

Figure 6:
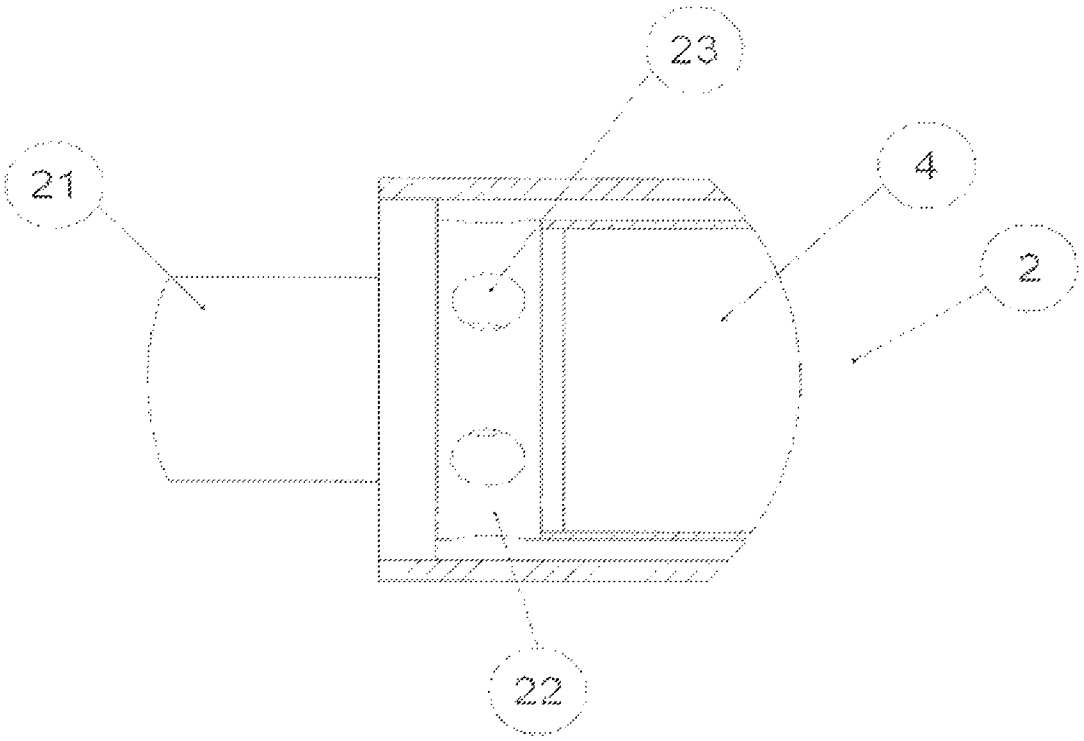
FIG. 6 shows the distributing device.

FIG. 6 is an enlarged view of the distributing device (2). The distributing devices comprise a connector (21) for an inlet or outlet tube and a connector (22) for the anode (4). The connector for the anode forms a hollow cylinder, which is flush with the anode tube or rod (4).

Radial holes (23) are distributed over the periphery of the hollow cylinder of the distributing device. Through the radial holes (23) in the distributing device, the electrolyte can be fed uniformly into the electrolytic space and, after passing through the electrolytic space, can be effectively conducted away. The distributing device preferably comprises three, more preferably four, and still more preferably five, radial holes.

EXAMPLE

The various peroxodisulphates are produced according to the following mechanisms:

Sodium Peroxodisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2Na^+ + S_2O_8^{2-} Na_2S_2O_8\downarrow$

Overall: $Na_2SO_4 + H_2SO_4 \rightarrow Na_2S_2O_8 + H_2\uparrow$

Ammonium Peroxodisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2NH_4^+ + S_2O_8^{2-} (NH_4)_2S_2O_8\downarrow$

Overall: $(NH_4)_2SO_4 + H_2SO_4 \rightarrow Na_2S_2O_8 + H_2\uparrow$

Potassium Peroxodisulphate:

Anode reaction: $2SO_4^{2-} \rightarrow S_2O_8^{2-} + 2e^-$

Cathode reaction: $H^+ + 2e^- \rightarrow H_2\uparrow$

Crystallisation: $2K^+ + S_2O_8^{2-} K_2S_2O_8\downarrow$

Overall: $K_2SO_4 + H_2SO_4 \rightarrow K_2S_2O_8 + H_2\uparrow$

In the following, the production according to the invention of sodium peroxodisulphate is described by way of example.

Both a two-dimensional and a three-dimensional cell, consisting of a boron-doped, diamond-coated niobium anode (diamond anode according to the invention), was used for this purpose.

Electrolyte Starting Composition:

Temperature: 25° C.

Sulphuric acid content: 300 g/l

Sodium sulphate content: 240 g/l

Sodium persulphate content: 0 g/l

Active anode surface area in the cell types used:

Tubular cell with platinum-titanium anode: 1280 $cm^2$

Tubular cell with diamond-niobium anode: 1280 $cm^2$

Flat cell with diamond-niobium anode: 1250 $cm^2$

Cathode material: acid-resistant high-grade steel: 1.4539

Solubility boundary (sodium persulphate) of the system: approximately 65 to 80 g/l.

Figure 1:
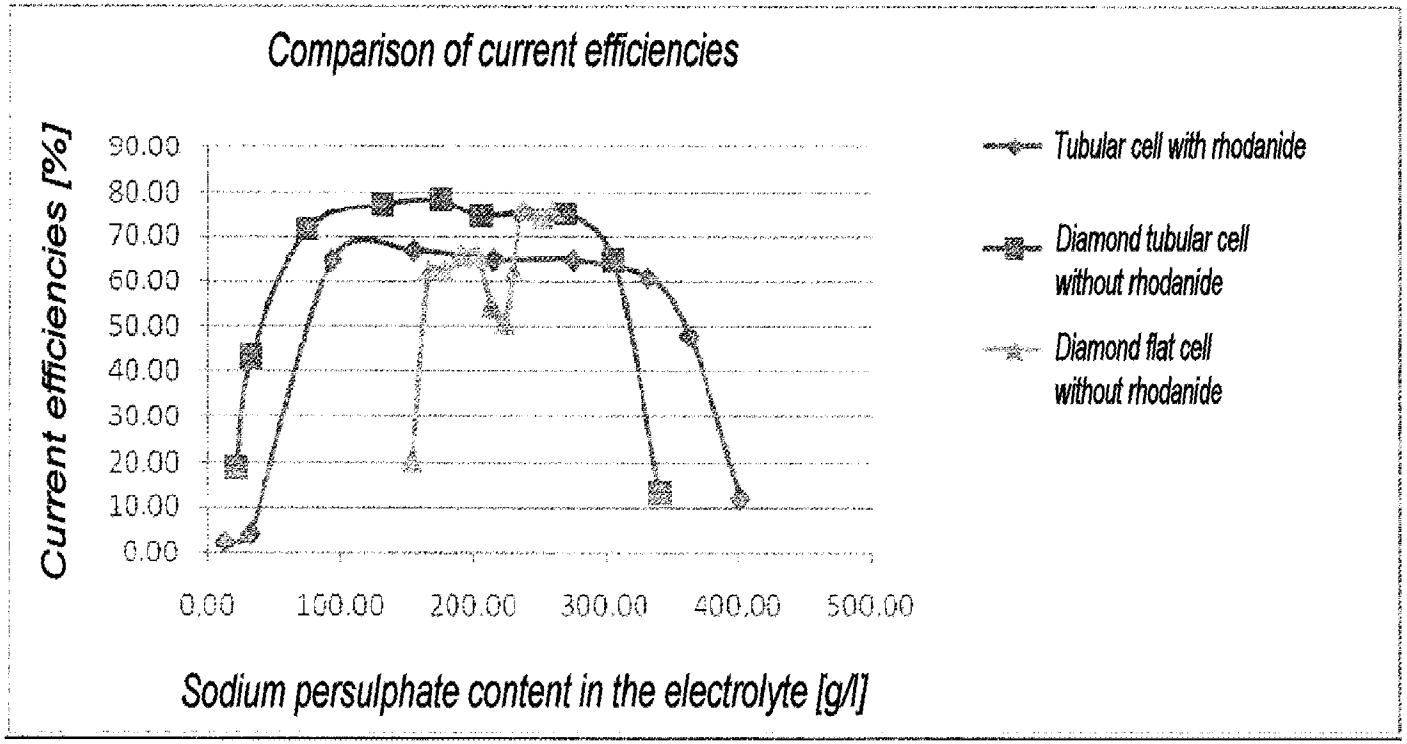
Figure 2A:
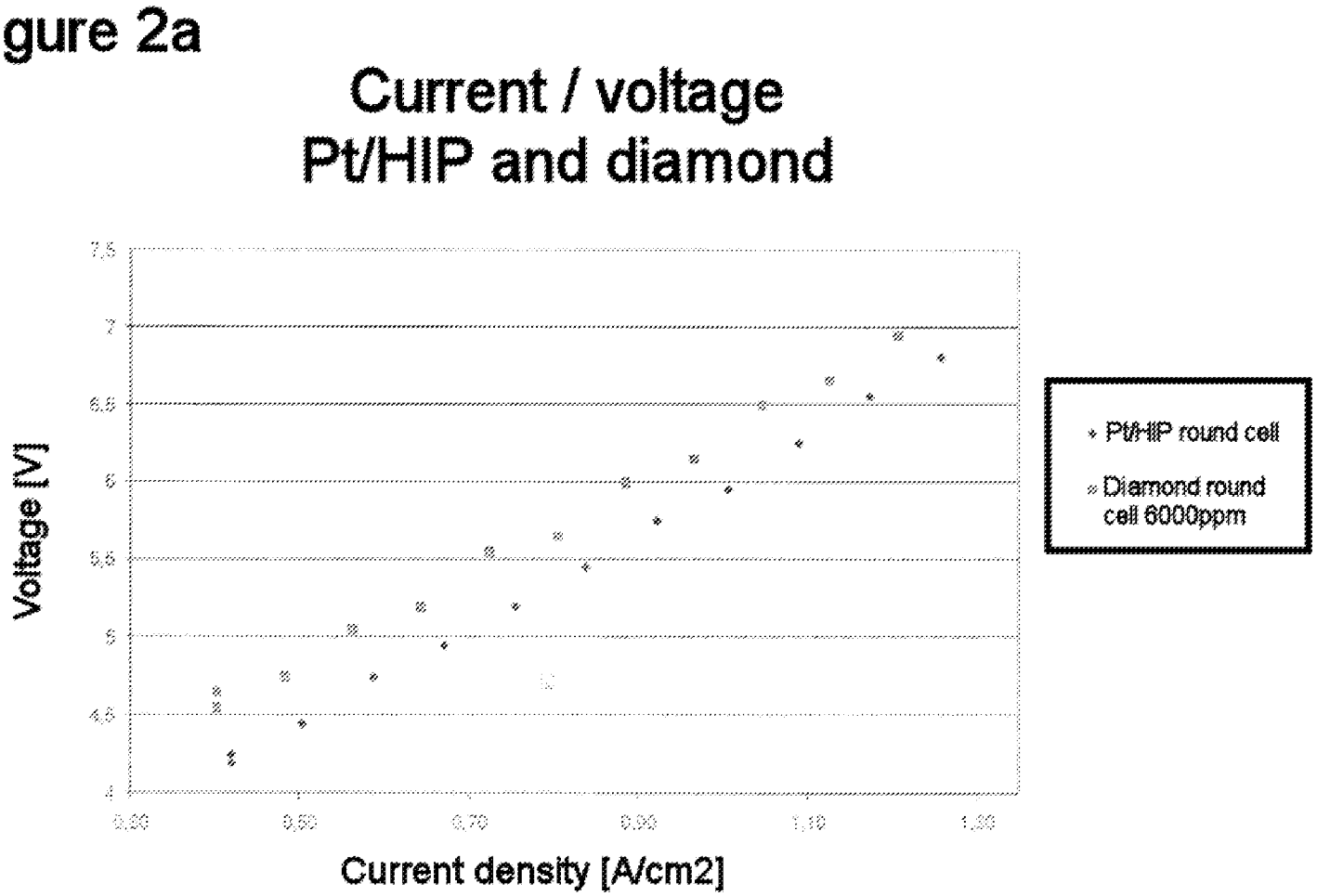
Figure 2B:
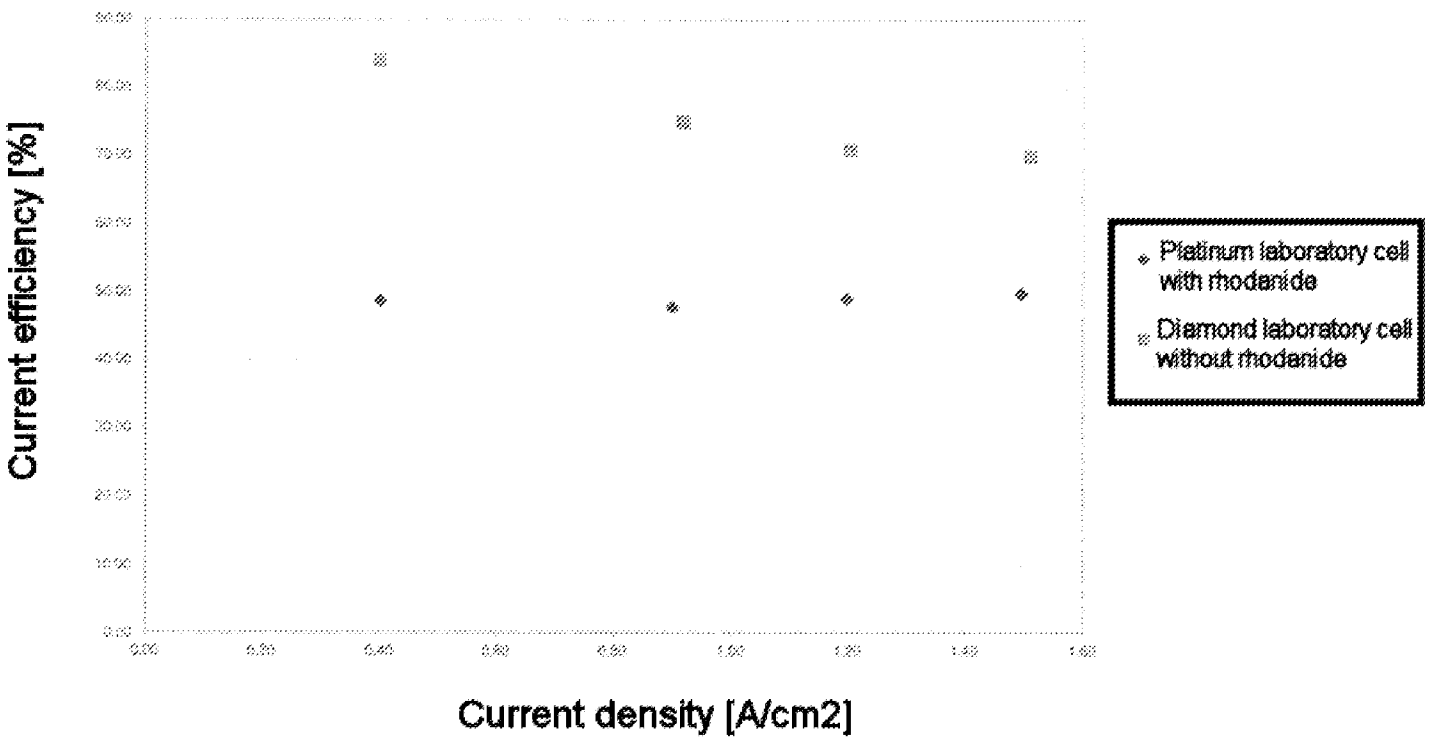
Figure 3:
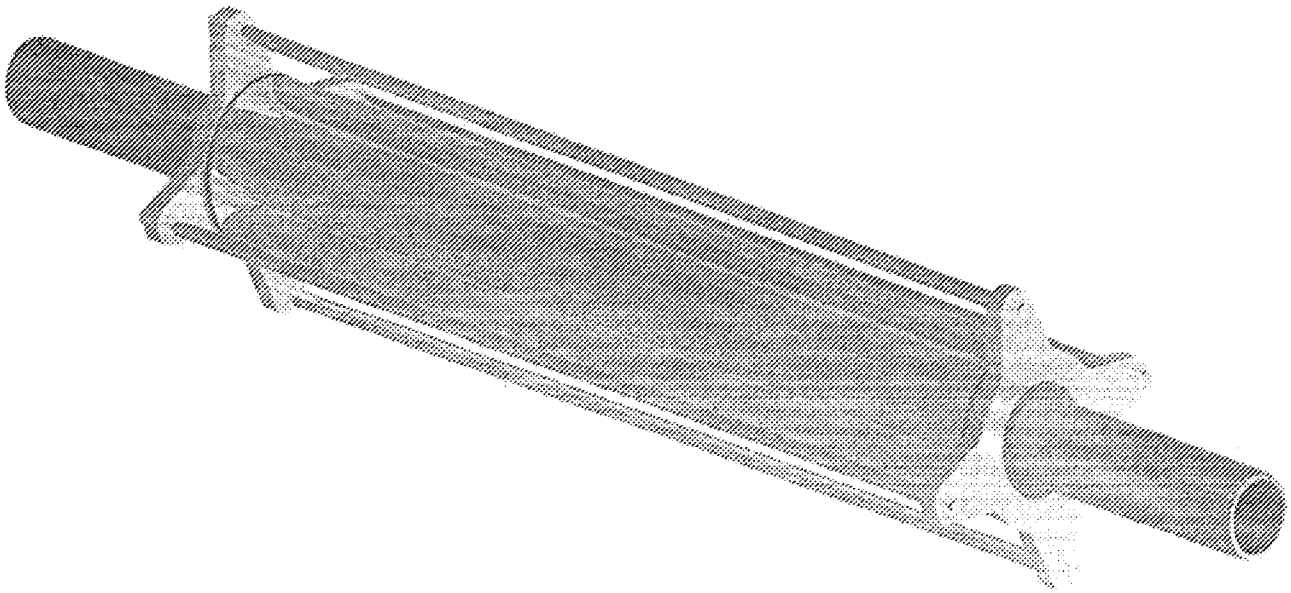
FIG. 3 is a plan view of an electrolytic cell according to the invention.

Current Densities:

The electrolyte was accordingly concentrated by recirculation (see FIGS. 1 and 2).

Results:

From the progression of the current efficiency as a function of altered sodium persulphate content (FIG. 1), it can clearly be seen that the diamond anode used reaches significantly higher current efficiencies over the entire operating range of approximately 100 g/l to approximately 350 g/l applicable to this cell, even without the addition of a promoter, than are known from conventional platinum-coated titanium anodes with added promoter.

From the progression of the current efficiency as a function of the current density during production of sodium peroxodisulphate using a platinum anode (comparative example) with the addition of corresponding promoter and in a boron-doped diamond anode to be used according to the invention, each installed in an undivided electrolytic cell (FIGS. 2*a* and 2*b*), it follows that a current efficiency of over 75% can be obtained at a current density of from 100 to 1500 $mA/cm^2$.

By contrast, however, the tests showed that conventional Pt-foil-coated titanium anodes only reached current efficiencies of at most 60 to 65% within this operating range, despite the addition of a sodium rhodanide solution as a promoter. However, without the addition of a promoter, current efficiencies of only 35% are achieved, and this substantiates the present invention.

In summary, it can be confirmed that even without the addition of a potential-increasing agent, the current efficiency of a diamond-coated niobium anode is approximately 10% higher than in a cell comprising a conventional platinum-titanium anode and the addition of a potential-increasing agent, and is approximately 40% higher than in a cell comprising a conventional platinum-titanium anode without the addition of a potential-increasing agent.

The drop in voltage at a diamond-coated anode is approximately 0.9 volts higher than in a comparable cell comprising a platinum-titanium anode. Furthermore, it was shown that the current efficiency in a diamond electrode to be used according to the invention without the addition of a promoter and having an increasing total sodium peroxodisulphate content in the electrolyte only decreases slowly—in some test conditions, for example at a current efficiency of equal to or greater than 65%, electrolyte solutions having a sodium peroxodisulphate content of approximately 400 to 650 g/l can be obtained.

By using a conventional platinum anode and also using a promoter in the electrolyte, by contrast only equally high peroxodisulphate concentrations of approximately 300 g/l can be obtained, and this is at a current efficiency of approximately 50%.

Brief tests on a similar system using potassium ions from potassium sulphate produced similarly good results.

It is surprising to a person skilled in the art that the method according to the invention can be performed at high levels of conversion by technically well manageable current densities without the spatial division of the anolyte and the catholyte and without the use of a promoter, at a high current efficiency and at high persulphate and solids concentrations in undivided cells without the addition of a promoter.

As part of the tests for this invention, it was determined that the production of ammonium peroxodisulphates, but primarily alkali-metal peroxodisulphates having a high current efficiency, is accordingly also possible in an undivided cell by using a diamond thin-film electrode doped with a trivalent or pentavalent element. Surprisingly, the cell can also be used in an economically viable manner with a very high solids content, i.e. peroxodisulphate content, and at the same time the use of a promoter can be completely omitted and electrolysis can be performed at high current densities, from which further advantages result, particularly in respect of installation and purchasing costs.

CONCLUSION

The use of an undivided cell makes possible electrolytic solutions having very high solids concentrations, whereby in turn the energy expenditure for salt extraction, essentially crystallisation and water evaporation, is significantly reduced directly proportionally to the increase in the proportion of solids, but is reduced at least to 25% of that of a divided cell.

Despite a promoter not being required and thus the purification measures required for the electrolysis gases being omitted, higher levels of conversion and higher persulphate concentrations can be achieved in the removed electrolyte.

The operating current density can be significantly reduced with respect to platinum anodes at identical production volumes, whereby less ohmic losses occur in the system and thus the energy required for cooling is reduced, and the degree of freedom in the design of the electrolytic cells and the cathodes is increased.

At the same time, the current efficiency and thus the production volume can be increased in the case of an increased current density.

Owing to the excellent abrasion resistance of the diamond-coated anode, much higher flow speeds can be used compared with a structurally similar Pt anode.

The invention claimed is:

1. An electrolysis cell, comprising:

(a) at least one tubular cathode;

(b) at least one rod-shaped or tubular anode, which comprises a conductive support coated with a conductive diamond layer;

(c) at least one inlet tube;

(d) at least one outlet tube; and, (e) at least two distributing devices, wherein the distributing devices comprise at least one connector for one outlet or inlet tube and one connector for the anode, wherein the distributing devices connect the anode to a current source and the connector for the anode forms a hollow cylinder having radial holes distributed over the periphery of the hollow cylinder.

2. The electrolysis cell of claim 1, wherein the electrolysis cell comprises a common electrolytic space without a diaphragm.

3. The electrolysis cell of claim 1, wherein the spacing between the anode outer surface and the cathode inner surface is between 1 and 20 mm.

4. The electrolysis cell of claim 1, wherein the internal diameter of the cathode is between 10 and 400 mm.

5. The electrolysis cell of claim 1, wherein the anode and the cathode, each independently of one another, are between 20 and 120 cm long.

6. The electrolysis cell of claim 1, wherein the conductive support is selected from the group consisting of silicon, germanium, titanium, zirconium, niobium, tantalum, molybdenum, tungsten, carbides of these elements, and/or aluminium or combinations of these elements.

7. The electrolysis cell of claim 1, wherein the diamond layer is doped with at least one trivalent or at least one pentavalent main group or B-group element.

8. The electrolysis cell of claim 1, wherein the cathode is made from lead, carbon, tin, platinum, nickel, alloys of these elements, zirconium and/or iron alloys.

9. The electrolysis cell of claim 1, wherein an electrolyte of the electrolysis cell is fed through the inlet tube.

10. The electrolysis cell of claim 1, wherein an electrolysis product is removed via the outlet tube of the electrolysis cell.

11. The electrolysis cell of claim 1, wherein the distributing device distributes the electrolyte into an electrolytic space.

12. The electrolysis cell of claim 1, wherein the components of the electrolysis cell can be individually replaced.

13. The electrolysis cell of claim 1, wherein the distributing device is permanently connected to the anode.

14. An electrolysis apparatus comprising at least two of the electrolysis cells of claim 1, wherein the electrolyte flows through the electrolysis cells one after the other and the electrolysis cells are electrochemically connected in parallel.

15. The electrolysis cell of claim 1, wherein the diamond layer is doped with boron and/or phosphorous.

16. The electrolysis cell of claim 1, wherein the cathode is made from acid-resistant high-grade steel.

17. The electrolysis cell of claim 1, wherein an electrolytic space is present as an annular gap between the anode and the cathode.

* * * * *